US006499281B1

(12) United States Patent
Fischer

(10) Patent No.: US 6,499,281 B1
(45) Date of Patent: Dec. 31, 2002

(54) DEFLECTING SUBASSEMBLY

(75) Inventor: Charles Fischer, Wohlen (CH)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 09/548,354

(22) Filed: Apr. 12, 2000

(30) Foreign Application Priority Data

May 5, 1999 (DE) ..... 199 20 724

(51) Int. Cl.[7] ..... G65B 13/00; G65B 13/04

(52) U.S. Cl. ..... 53/589; 53/389.4; 53/589; 53/582; 53/588; 242/615.1; 242/615.3; 242/615.2; 242/615.21

(58) Field of Search ..... 53/589, 582, 588, 53/389.4; 100/29, 33 PB; 242/615.1, 615.21, 615.3, 615.2

(56) References Cited

U.S. PATENT DOCUMENTS

| | | | | | |
|---|---|---|---|---|---|
| 4,059,211 | A | * | 11/1977 | Brizzolara | 226/11 |
| 4,559,767 | A | | 12/1985 | Takami | |
| 5,112,004 | A | * | 5/1992 | Tipton | 226/118.4 |
| 5,251,844 | A | * | 10/1993 | Albrecht et al. | 226/196.1 |
| 5,379,576 | A | * | 1/1995 | Koyama | 100/26 |
| 5,562,057 | A | * | 10/1996 | Lenson | 112/113 |
| 5,615,538 | A | * | 4/1997 | Miyashita et al. | 53/582 |
| 5,755,084 | A | * | 5/1998 | Dekker | 100/26 |
| 5,803,168 | A | * | 9/1998 | Lormand et al. | 166/77.2 |
| 5,815,911 | A | * | 10/1998 | Hase et al. | 242/348.3 |
| 5,888,342 | A | * | 3/1999 | Reinders | 156/494 |
| 6,116,526 | A | * | 9/2000 | Bom et al. | 239/657 |

FOREIGN PATENT DOCUMENTS

| | | |
|---|---|---|
| CH | 384 450 A | 11/1964 |
| DE | 33 00 039 A | 7/1983 |
| DE | 298 22 344 U1 | 4/1999 |
| EP | 0 620 150 A1 | 10/1994 |
| JP | 1-213109 A | 8/1989 |

* cited by examiner

*Primary Examiner*—Rinaldi I. Rada
*Assistant Examiner*—Gloria R Weeks
(74) *Attorney, Agent, or Firm*—Oliff & Berridge, PLC

(57) ABSTRACT

A deflecting subassembly 10 for the guided deflection of a band 12 consisting, in particular, of plastic may be provided, in particular, for a strapping machine 16 comprising a strapping subassembly 14, for the purpose of deflecting the band 12 in a region located between a band store 18 and the strapping subassembly 14. The deflecting subassembly comprises a deflecting roller 20, a band-inlet channel 22, which is arranged upstream of the deflecting roller 20, a band-outlet channel 24, which is arranged downstream of the deflecting roller 20, it being possible for the band-inlet channel 22 and the band-outlet channel 24 to be adjusted relative to one another, and an outer, flexible directing member 26 which bridges the interspace between the band-inlet and band-outlet channels 22 and 24, respectively, and is located opposite the outer circumference of the inner deflecting roller 20.

17 Claims, 4 Drawing Sheets

DEFLECTING SUBASSEMBLY

BACKGROUND OF THE INVENTION

1. Field of Invention

The invention relates to a deflecting subassembly for the guided deflection of a band consisting, in particular, of plastic, in particular for a strapping machine comprising a strapping subassembly, for the purpose of deflecting the band in a region located between a band store and the strapping subassembly.

2. Description of Related Art

If such a deflecting subassembly is inserted, for example, between the strapping subassembly of a strapping machine, which serves for strapping the relevant item which is to be strapped, and a band store provided, for example, in roll form, then, depending on the design, position and/or relative position of the strapping machine and of the band store, it is also possible, in particular, for different band-deflecting angles to be necessary. If the plastic band is guided, for example, over a deflecting roller, this results in correspondingly different angles of wrap. However, the hitherto conventional deflecting subassemblies are usually only suitable for one specific application or a small number of specific applications. Changeover is quite possible, but usually involves relatively high outlay.

SUMMARY OF THE INVENTION

The object of the invention is to provide a deflecting subassembly of the type mentioned in the introduction which, with the construction kept as simple as possible, can easily also be adapted, in particular, to different circumstances.

In order to achieve this object, according to the invention, the deflecting subassembly has a deflecting roller, a band-inlet channel, which is arranged upstream of the deflecting roller, a band-outlet channel, which is arranged downstream of the deflecting roller, it being possible for the band-inlet channel and the band-outlet channel to be adjusted relative to one another, and an outer, flexible directing member which bridges the interspace between the band-inlet and band-outlet channels and is located opposite the outer circumference of the inner deflecting roller.

This design allows the deflecting subassembly to be adapted quickly and easily to different circumstances, reliable band guidance always being ensured irrespective of the relative position of the two band channels in each case and irrespective of the angle of wrap via which the band has to be guided over the deflecting roller in each case. Since the directing member is flexible, it is automatically adapted to the relative position of the two band channels in each case, this ensuring optimum bridging of the interspace and correspondingly reliable band guidance in each case.

In a preferred practical embodiment, the flexible directing member is supported on the band-inlet channel by way of one end and on the band-outlet channel by way of its other end. It is advantageous here if said flexible directing member is fixed on the outside of the band-inlet channel by way of one end and is introduced into the band-outlet channel by way of its other end. Depending on the relative position of the two band channels, the relevant band end thus projects to a more or less pronounced extent into the band-outlet channel. The length of the flexible directing member is to be dimensioned such that, even with a maximum distance between the two mutually facing channel ends, the free end of said directing member is still located in the band-outlet channel. This means that, with all the angles of deflection or wrap, the situation where the band strikes against an edge as it is pushed in is ruled out.

In an expedient practical embodiment of the deflecting subassembly according to the invention, the band-inlet channel can be adjusted into various positions relative to the deflecting roller and can preferably be fixed in these positions in each case. It is thus possible, for example, for the band-inlet channel to be adjusted correspondingly for use in different circumstances, but to maintain the respectively predetermined position during use in each case.

It is possible in this case for the band-inlet channel to be mounted pivotably, for example, on a spindle which preferably coincides with the spindle of the deflecting roller and preferably to be fixed in its respective pivot position.

Alternatively, or in addition, it is also possible for the band-outlet channel to be adjusted into various positions relative to the deflecting roller. In this case, said band-outlet channel can preferably be moved out of the various positions counter to a spring force in each case. This makes it possible for the band-outlet channel to follow changes in the band-running direction as caused, for example, by a respective strapping operation.

It is possible in this case for the band-outlet channel to be mounted pivotably, for example, on a spindle which coincides preferably with the spindle of the deflecting roller and to be retained preferably resiliently in its respective pivot position.

The flexible directing member is preferably formed by a directing plate.

According to a preferred practical embodiment of the deflecting subassembly according to the invention, the band-inlet channel is fastened releasably on a carrier. Alternatively, or in addition, it is also possible for the band-outlet channel to be fastened releasably on such a carrier. The respective band channel can thus be exchanged. This makes it possible, for example, to use elements of different lengths as required.

The invention is explained in more detail hereinbelow, using an exemplary embodiment, with reference to the drawing, in which:

DETAILED DESCRIPTION OF PREFERRED EMBODIMENTS

Figure 1:
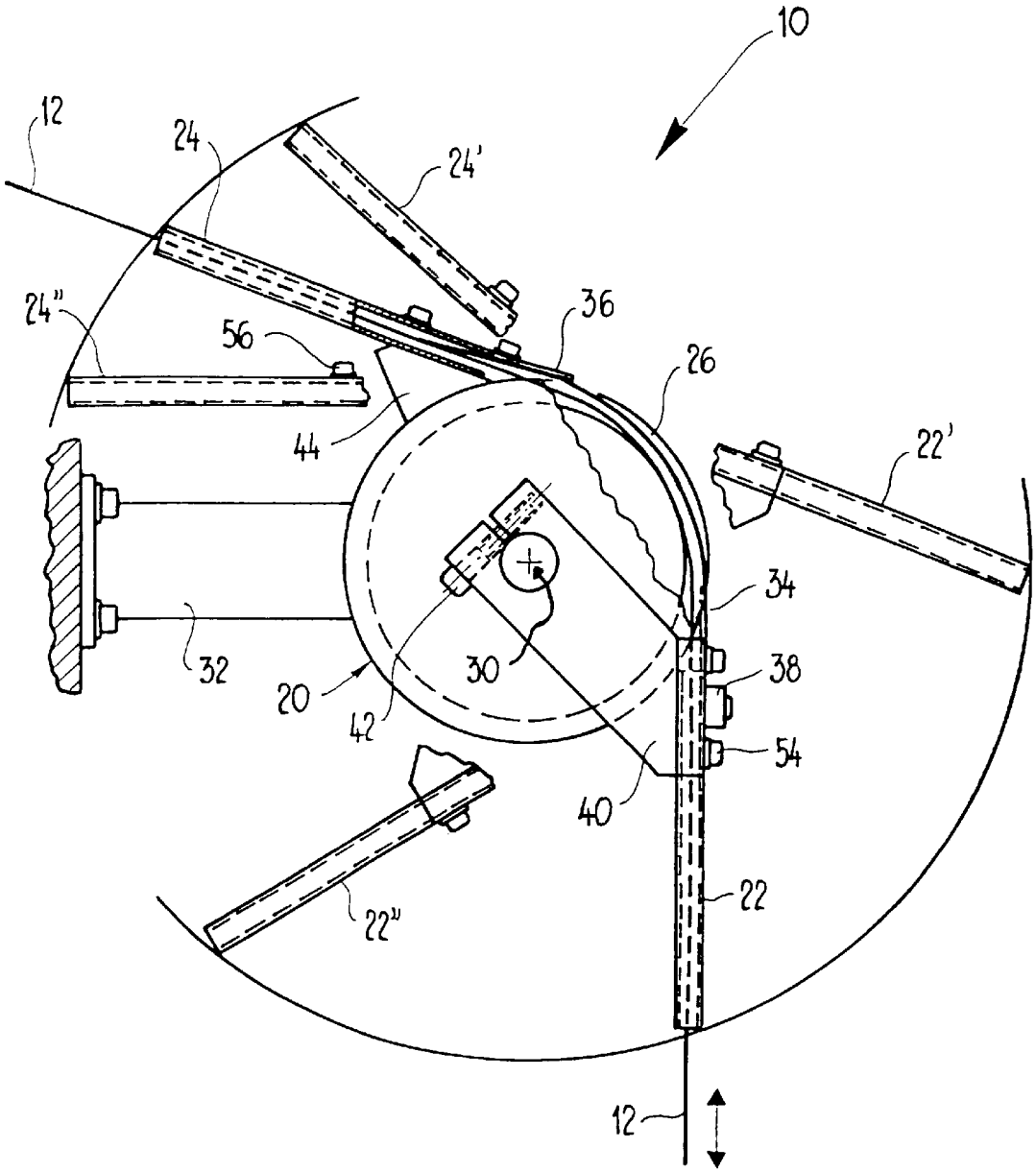
FIG. 1 shows a schematic side view of a deflecting subassembly.

FIGS. 1 to 4 show purely schematic illustrations of a deflecting subassembly 10 for the guided deflection of a band 12 consisting, for example, of plastic.

Such a deflecting subassembly 10 is suitable, in particular, for a strapping machine 16 (illustrated in FIG. 5) comprising a strapping member 14. In this case, the deflecting subassembly 10 may be arranged, in particular, in the region located between a band store 18 and the strapping subassembly 14.

As can be seen from FIGS. 1 to 4, the deflecting subassembly comprises a deflecting roller 20, a band-inlet channel 22, which is arranged upstream of the deflecting roller 20, and a band-outlet channel 24, which is arranged downstream of the deflecting roller 20. It is possible for the band-inlet channel 22 and the band-outlet channel 24 to be adjusted relative to one another.

Furthermore this deflecting member 10 comprises an outer, flexible directing member which bridges the interspace between the band-inlet and band-outlet channels 22 and 24, respectively, is located opposite the outer circumference of the inner deflecting roller 20 and, in the present case, is formed by a flexible directing plate 26.

Figure 4:
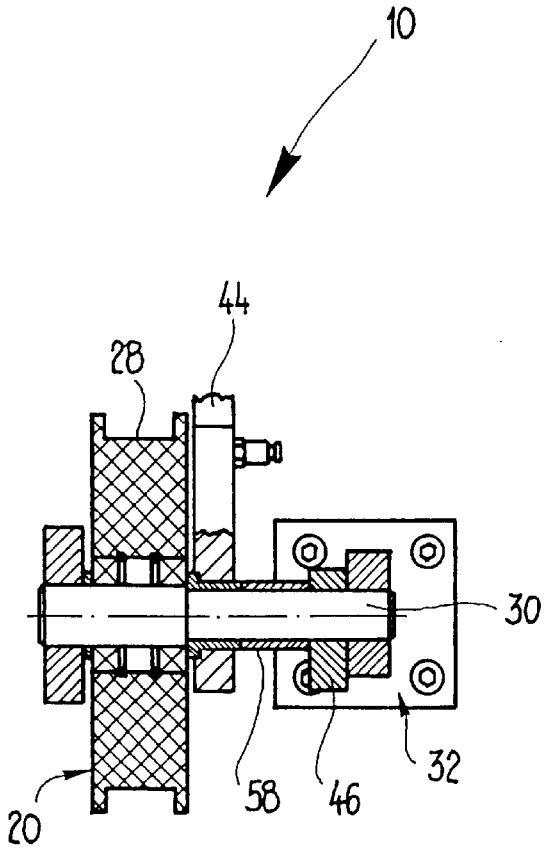
FIG. 4 shows a schematic longitudinal-section illustration of part of the deflecting subassembly.

As can be seen, in particular, from FIG. 4, the deflecting roller 20 has a circumferential groove 28 in which the plastic band 12 is guided correspondingly. In the region between the two band channels 22, 24, the circumferential groove 28 is covered by the flexible directing plate 26, with the result that the plastic band 12 is guided reliably between the base of the groove 28 and said directing plate 26, i.e. it is retained within the circumferential groove 28.

Figure 2:
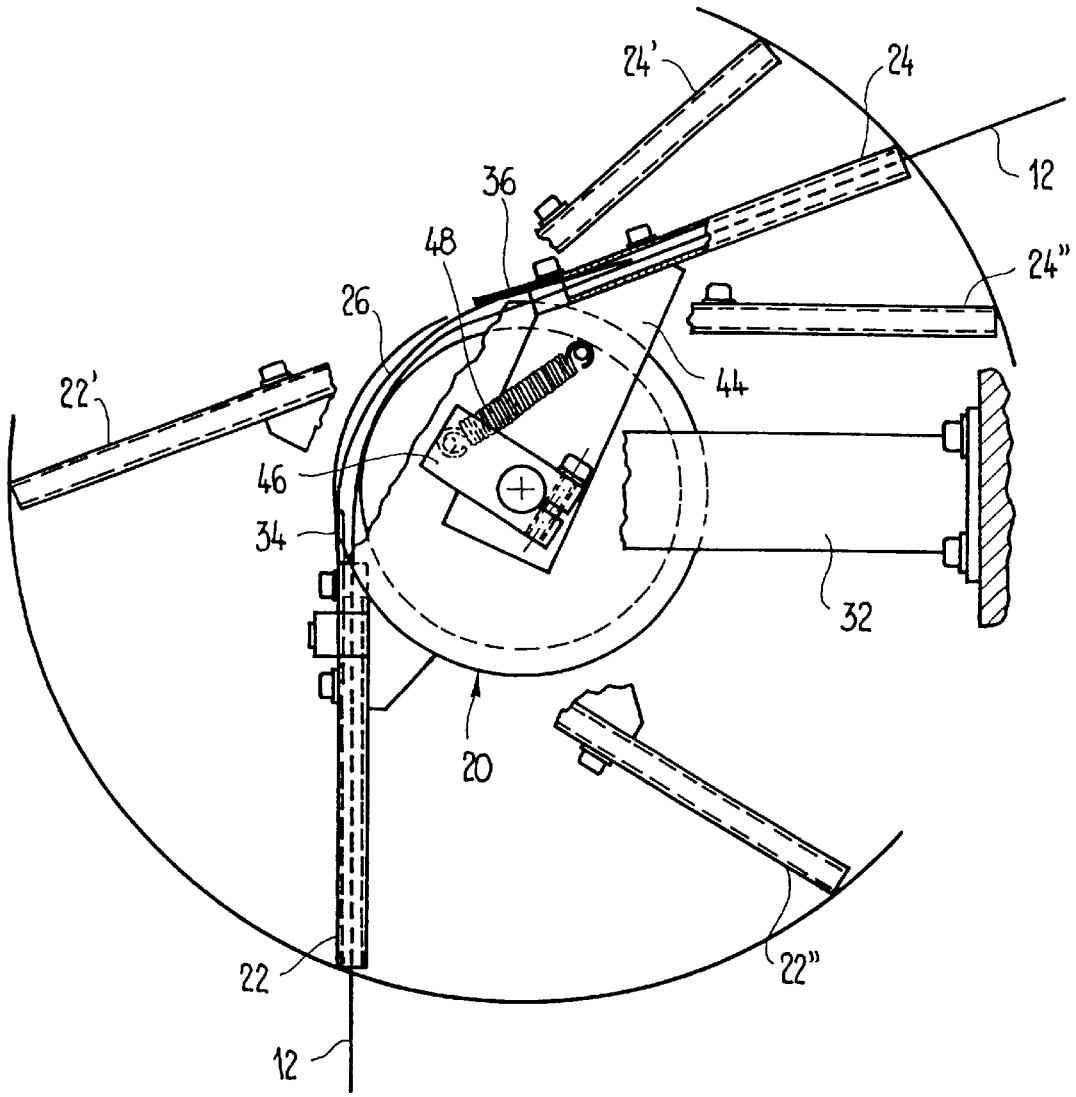
FIG. 2 shows a schematic view of a deflecting subassembly from the opposite side.
Figure 3:
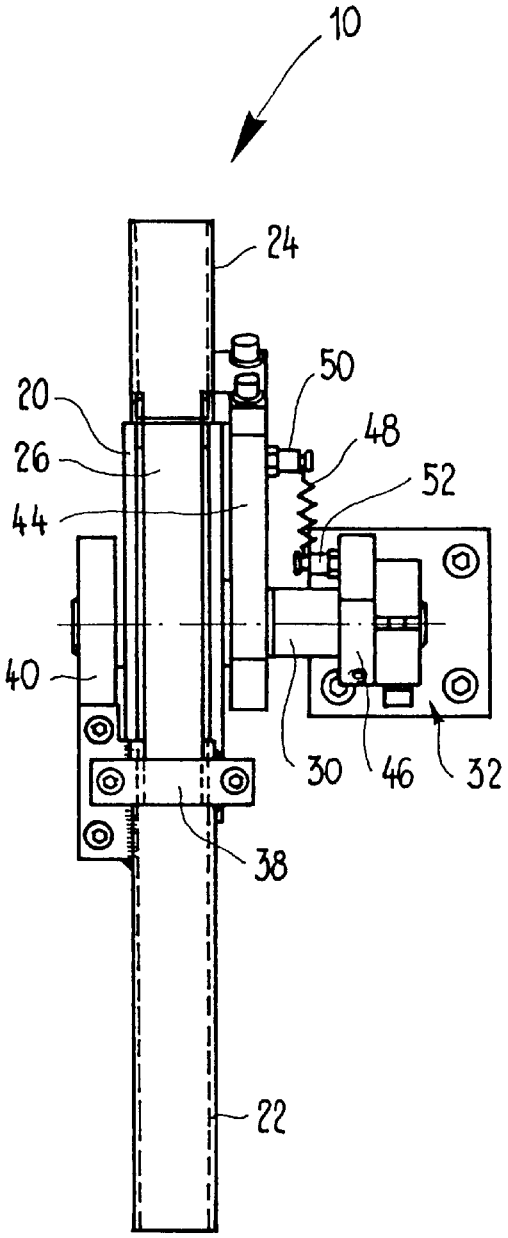
FIG. 3 shows a schematic plan view of the deflecting subassembly according to FIGS. 1 and 2.

As can be seen from FIGS. 1 and 2, the flexible directing plate 26 can extend into the circumferential groove 28 at least in its central region.

In the present exemplary embodiment, the deflecting roller 20 is mounted rotatably on a spindle 30, which is provided in a rotationally fixed manner on a fastening arm 32. In the present case, said fastening arm 32 is arranged laterally. However, it is also possible, in principle, for it to be arranged, for example, at the top or bottom.

The flexible directing plate 26 is supported on the band-inlet channel 22 by way of one end 34 and on the band-outlet channel 24 by way of its other end 36. In this case, the flexible directing plate 26 is fixed on the outside of the band-inlet channel 22 by way of one end 34 using fastening means 38 and is introduced into the band-outlet channel 24 by way of its other, free end 36.

The band-inlet channel 22 can be adjusted into various positions relative to the deflecting roller 20 and can preferably be fixed in these positions in each case. For this purpose, the band-inlet channel 22 is provided on a carrier 40 which is mounted pivotably on the rotationally fixed spindle 30 and can be fixed in its pivot position in each case, for example, via a clamping screw 42. Three different pivot positions 22, 22', 22" of the band-inlet channel 22 are illustrated in FIGS. 1 and 2.

It is also possible for the band-outlet channel 24 to be adjusted into various positions relative to the deflecting roller 20. The band-outlet channel 24 can preferably be moved out of these adjustable, predeterminable positions in each case counter to a spring force. For this purpose, the band-outlet channel 24 is provided on a carrier 44 which is mounted pivotably on the rotationally fixed spindle 30 and is retained preferably resiliently in a predeterminable pivot position.

In the present exemplary embodiment, a tension spring 48 is provided between the carrier 44, which is assigned to the band-outlet channel 24, and a clamping part 46 which can be adjusted on the spindle 30 (see, in particular, FIGS. 2 to 4), and the carrier 44, and thus the band-outlet channel 24, is retained resiliently in the respectively set predetermined pivot position by said tension spring. The respectively desired starting pivot position of the band-outlet channel 24 can be set by corresponding adjustment of the clamping part 46 on the rotationally fixed spindle 30. The band-outlet channel 24 may then be moved out of this set starting pivot position counter to the force of the tension spring 48, with the result that it can follow changes in the running direction of the plastic band 12 as occur, for example, during a strapping operation. As can best be seen from FIG. 3, in each case one stub 50, 52 is respectively provided on the carrier 44 and on the clamping part 46, and a respective end of the tension spring 48 is fitted on said stub.

Three different starting positions 24, 24', 24" of the band-outlet channel which can be set via the clamping part 46 are illustrated in FIGS. 1 and 2.

The two band channels 22, 24 may be formed in each case, for example, by a closed profile.

The band-inlet channel 22 is fastened releasably on the associated carrier 40 by fastening means 54. Accordingly, the band-outlet channel 24 is also fastened releasably on the associated carrier 44 by fastening means 56. The two band channels 22, 24 can thus be exchanged. This makes it possible to use elements of different lengths as required.

As can be seen from FIG. 4, the carrier 44, which is assigned to the band-outlet channel 24, is seated on a bearing sleeve 58 which is pushed on to the rotationally fixed spindle 30 and can be rotated relative to the same.

Figure 5:
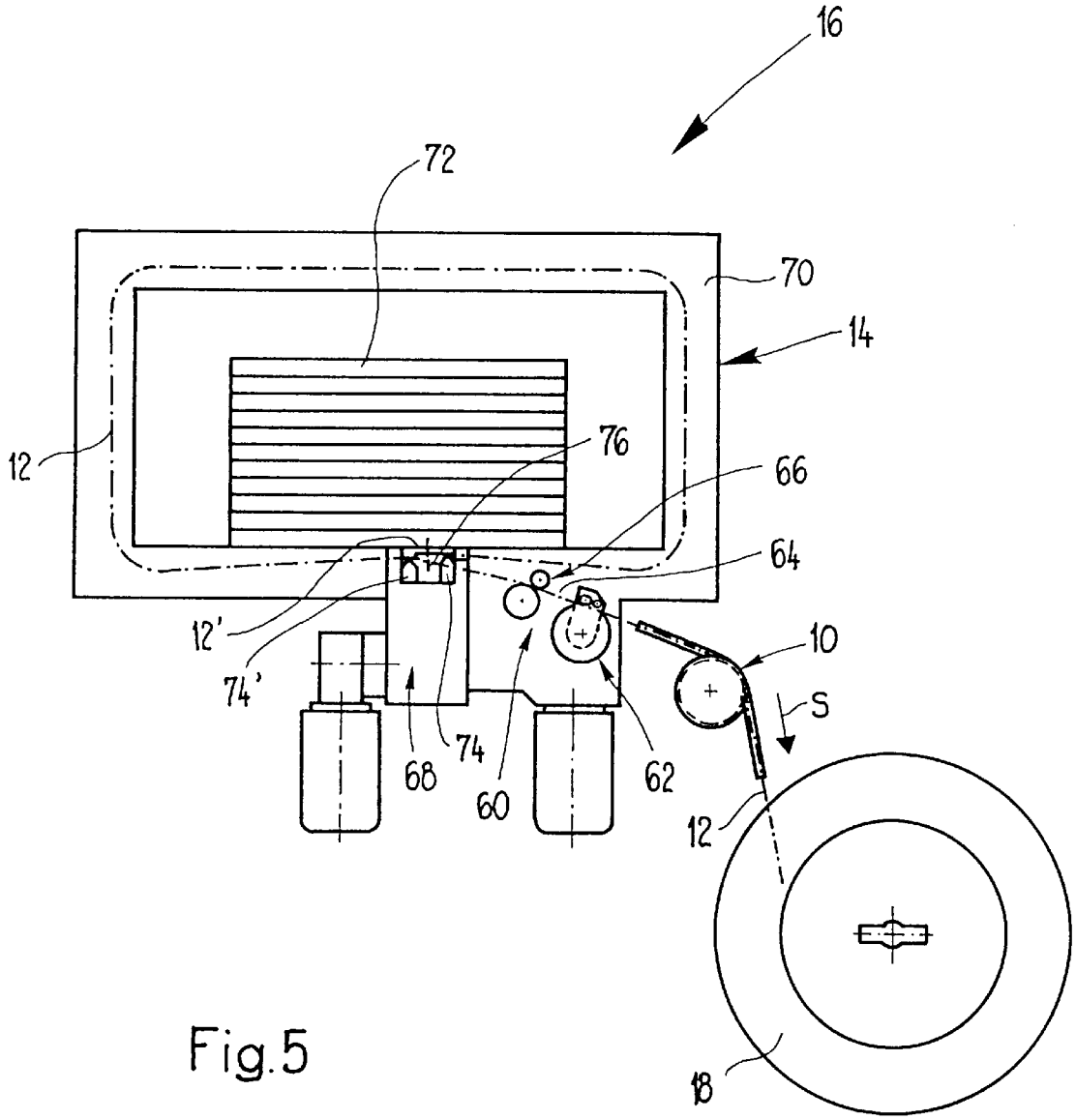
FIG. 5 shows a schematic side view of a strapping machine with associated deflecting subassembly.

As can best be seen from FIG. 5, the deflecting subassembly 10 may be arranged, for example, in the region between a band store 18 and the strapping subassembly 14 of a strapping machine 16.

According to FIG. 5, the strapping machine 16 or its strapping subassembly 14 comprises a band-introducing and tensioning subassembly 60 which is provided with a tensioning device 62 for the final tensioning of the plastic band 12. A pair of conveying rollers 66 connected to a reversible drive is arranged in the region of a guide channel 64. The plastic band 12, which comes from the unwinding means 18 and is guided through the tensioning device 62, is intended to be fed by said pair of conveying rollers in an advancement direction, which is counter to the tensioning direction S, through a clamping and sealing subassembly 68 and into a guide frame 70, with the free band end 12' in front, until the band end 12' butts against a stop in the clamping and sealing subassembly 68. The guide frame 70 runs around the item which is to be strapped 72. The plastic band 12, which is guided around the item which is to be strapped 72 and is clamped firmly, by means of a first band-clamping unit 74 of the clamping and sealing subassembly 68, at a distance from the band end 12' butting against the stop, is also intended to be drawn back in the tensioning direction S by means of the pair of conveying rollers 66 until it is positioned on the item which is to be strapped 72.

The clamping and sealing subassembly 68 has a second band-clamping unit 74' and a welding unit 76 between the band-clamping units 74 and 74'.

Once the pair of conveying rollers 66 has drawn back the plastic band 12 in the tensioning direction S and positioned the same on the item which is to be strapped 72, the tensioning device 62 comes into operation, as a result of which the plastic band 12 is gripped and tensioned to the predetermined tensioning force. As soon as this has been reached, the clamping and sealing subassembly 68 comes into operation by the second band-clamping unit 74' clamping the plastic band 12 firmly and the welding unit 76 welding the two overlapping sections of the plastic band 12 together by heating and clamping. Thereafter, the plastic band 12 is severed downstream of the welding location, as seen in the tensioning direction S, by means of the clamping and sealing subassembly 68.

What is claimed is:

1. A deflecting device for the guided deflection of a strapping band in a strapping machine comprising: a rotatably mounted deflecting roller having an outer circumference, a band-outlet channel which is arranged downstream of the deflecting roller, means for adjusting the relative angular position of both the band-inlet channel and the band-outlet channel, and an outer, flexible directing member located opposite the outer circumference of the deflecting roller, the flexible directing member and the deflection roller forming a guide channel for the strapping band, the flexible member bridging the space between the band inlet channel and band outlet channel.

2. The deflecting device as claimed in claim 1, wherein the flexible directing member is supported on the band-inlet channel by way of one end and on the band-outlet channel by way of its other end.

3. The deflecting device as claimed in claim 2, wherein the flexible directing member is fixed on the outside of the band-inlet channel by way of one end and is introduced into the band-outlet channel by way of its other end.

4. The deflecting device as claimed in claim 1, wherein the band-inlet channel can be adjusted into various positions relative to the deflecting roller.

5. The deflecting device as claimed in claim 4, wherein the band-inlet channel is mounted pivotably on a spindle.

6. The deflecting device as claimed in claim 5, wherein the band-inlet channel is mounted on a spindle that coincides with the spindle of the deflecting roller.

7. The deflecting device as claimed in claim 5, wherein the band-inlet channel is fixed in its respective pivot position.

8. The deflecting device as claimed in claim 4, wherein the band-inlet channel can be fixed into the various positions relative to the deflecting roller.

9. The deflecting device as claimed in claim 1, wherein the band-outlet channel can be adjusted into various positions relative to the deflecting roller.

10. The deflecting device as claimed in claim 9, wherein the band-outlet channel is mounted pivotably on a spindle.

11. The deflecting device as claimed in claim 10, wherein the band-outlet channel is mounted on a spindle that coincides with the spindle of the deflecting roller.

12. The deflecting device as claimed in claim 10, wherein the band-outlet channel is retained resiliently in its respective pivot position.

13. The deflecting device as claimed in claim 9, wherein the band-outlet channel can be moved out of the various positions relative to the deflecting roller counter to a spring force.

14. The deflecting device as claimed in claim 1, wherein the flexible directing member is formed by a directing plate.

15. The deflecting device as claimed in claim 1, wherein the band-inlet channel is fastened releasably on a carrier.

16. The deflecting device as claimed in claim 1, wherein the band-outlet channel is fastened releasably on a carrier.

17. A strapping machine comprising the deflecting device as defined in claim 1, a strapping device and a band store, the deflecting device being located between the band store and the strapping device for deflecting the strapping band in a region located between the band store and the strapping device.

* * * * *